US007104264B2

(12) United States Patent
Lee et al.

(10) Patent No.: US 7,104,264 B2
(45) Date of Patent: Sep. 12, 2006

(54) RIGID AIR DUCTING FOR RESPIRATOR HOODS AND HELMETS

(75) Inventors: Peter D. Lee, Cleveland (GB); Christopher P. Henderson, Brandon (GB)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/809,106

(22) Filed: Mar. 26, 2004

(65) Prior Publication Data

US 2004/0216736 A1 Nov. 4, 2004

(30) Foreign Application Priority Data

Mar. 28, 2003 (GB) ..... 0307198.2

(51) Int. Cl.
*A62B 17/04* (2006.01)
*A42C 5/04* (2006.01)

(52) U.S. Cl. ..... 128/201.22; 128/201.24; 2/171.3

(58) Field of Classification Search ..... 128/200.24, 128/201.22, 201.23, 201.24, 201.25, 201.29, 128/202.11, 202.27, 205.25, 206.12, 206.16, 128/206.17, 206.21, 206.23, 206.24, 206.28, 128/207.11, 200.27, 200.28, 201.12, 201.14, 128/201.15; 2/171.3, 422, 424, 410, 202
See application file for complete search history.

(56) References Cited

U.S. PATENT DOCUMENTS 566,557 A * 8/1896 Bayles et al. ..... 128/201.23
2,296,338 A * 9/1942 Dakin ..... 128/201.15
3,223,086 A 12/1965 Denton
3,413,972 A 12/1968 Depping
3,736,927 A * 6/1973 Misaqi ..... 128/201.25
3,822,698 A 7/1974 Guy
3,963,021 A * 6/1976 Bancroft ..... 128/201.25
4,172,294 A 10/1979 Harris
4,207,883 A 6/1980 Shindler
4,227,520 A * 10/1980 Lord ..... 128/201.24
4,280,491 A 7/1981 Berg et al.
4,411,264 A 10/1983 Jacobson
4,458,680 A 7/1984 Childers et al.
4,583,535 A 4/1986 Saffo
4,637,383 A 1/1987 Lopez
4,815,458 A * 3/1989 Sing ..... 128/201.25
4,889,113 A 12/1989 Pelloux-Gervais et al.
5,050,240 A 9/1991 Sayre
5,283,914 A * 2/1994 James ..... 2/424
H1316 H 6/1994 McGuinness
D398,421 S 9/1998 Crafoord et al.

(Continued)

FOREIGN PATENT DOCUMENTS

DE 2932348 2/1981

(Continued)

*Primary Examiner*—Teena Mitchell
(74) *Attorney, Agent, or Firm*—Karl G. Hanson

(57) ABSTRACT

A respirator hood 1 that has an air chamber 6 arranged above the head of a user for delivery of breathable air. The air chamber 6 has an air inlet 13 connected to an air supply hose 5 and an air outlet 17 The outlet 17 is arranged to direct air away from the eyes of the user. The air chamber 6 forms an air duct 12 that substantially covers the top of the hood 1 above the user's head. The duct 12 is collapse-resistant so that the duct shape is maintained in use and air flow through the duct 12 is substantially unrestricted. As a result, a substantially uniform air flow can be achieved in use, which air flow pattern is repeatable from day to day and from hood to hood.

45 Claims, 7 Drawing Sheets

U.S. PATENT DOCUMENTS

| | | | | |
|---|---|---|---|---|
| 6,240,567 | B1 * | 6/2001 | Johnston | 2/202 |
| 6,374,823 | B1 * | 4/2002 | Hajianpour | 128/201.22 |
| 2001/0052144 | A1 | 12/2001 | Paris et al. | |

FOREIGN PATENT DOCUMENTS

| | | | |
|---|---|---|---|
| EP | 468188 | A1 | 1/1992 |
| FR | 2106753 | | 5/1972 |
| GB | 1343132 | | 1/1974 |
| GB | 2061696 | A | 5/1981 |
| GB | 2203050 | A | 10/1988 |
| SU | 986429 | | 1/1983 |
| WO | WO 83/00632 | | 3/1983 |

* cited by examiner

RIGID AIR DUCTING FOR RESPIRATOR HOODS AND HELMETS

This application claims priority from Great Britain Application No. 0307198.2 filed Mar. 28, 2003.

This invention pertains to respirator hoods and helmets that are worn on a user's head to provide breathable air to the hood/helmet interior.

BACKGROUND

Respirator hoods and helmets are well known and have many uses. For example, the hoods may be used to allow the user to breathe safely in a contaminated atmosphere, such as a smoke filled atmosphere, in a fire or a dust laden atmosphere, in a mine or a toxic atmosphere, or in a laboratory.

Respirator hoods and helmets also may be worn where it is desired to prevent the user from contaminating the surrounding atmosphere, such as when working in a clean room used to manufacture silicon chips.

Respirator helmets have a hard shell that provides head protection against impacts when working in a dangerous environment where the user is at risk of being struck by falling debris such as in a mine or on a building site.

Respirator hoods can be used where head protection is not required, for example, when working in a laboratory or a clean room. In such situations, the hoods are usually made of soft, flexible material for comfort and lightness.

The present invention has particular application to respirator hoods and in the following description and claims the term "hood" is used to mean "a loose fitting face piece that covers at least the face of the user but does not provide head protection" and is to be construed accordingly. It will be understood, however, that the invention is not limited to respirator hoods and, where the context permits, has application to both respirator hoods and respirator helmets.

One type of known respirator hood has a top wall and a side wall extending from the perimeter of the top wall in which the head of the user is received so as to enclose the head. Hoods of this type are commonly used with a body suit to isolate the user from the environment in which they are working.

The top wall and side wall are usually made of a soft material suitable for the environment in which the hood is to be worn and an apron or skirt may be provided at the lower end of the side wall that extends over the shoulder region of the user and covers the interface with the body suit.

The hood has a transparent region at the front, commonly referred to as a visor, through which the user can see. The visor may be an integral part of the hood or detachable so that it can be removed and replaced if damaged. The visor may extend to the sides of the hood and/or over the top of the hood to provide substantially unrestricted vision.

Examples of this type of hood are disclosed in UK Patent No. 1343132 and U.S. Pat. No. 4,458,680. In both these patents, the hood is provided with an air duct extending around the perimeter of the top wall on the inside of the hood. The duct is connected to an incoming air supply pipe that passes through the inside of the hood behind the head of the user and has an array of outlet holes arranged to direct air down towards the user's face.

The air supply pipe may be connected to a remote air source separate from the user, but for many applications the air supply pipe is connected to a portable air source carried by the user, usually on the back. A common portable air source comprises a turbo unit, including a fan driven by a motor powered by a battery and a filter. The device is intended to provide a breathable air supply for a predetermined period of time, typically four hours.

A problem with known respirator hoods is that the air duct is regularly made of soft, flexible material similar to the hood. As a result, the shape and volume cab be unstable, and local variations in the cross-section of the air duct can occur from day-to-day and from one hood to another. Variations in duct cross-section can restrict the air flow the user and, in extreme cases, the duct may even close to shut-off the air supply.

A reduced air flow may be insufficient to provide the user with an acceptable volume of breathable air and to flush exhaled air containing a higher carbon dioxide content from the hood. As a result, a build-up of carbon dioxide may occur, giving rise to potentially serious health and safety risks. For example, the user may become dizzy, feel claustrophobic, and eventually collapse. This can be a problem when the hoods are connected to a portable breathable air supply or a separate, remote air supply.

Variations in air duct cross-section can also increase the back pressure that, in turn, affects battery performance for the portable powered air supply. In particular, the turbo unit must work harder to overcome the higher back pressure, which requires more power and consumes battery life.

Another problem with known respirator hoods is that the duct air outlet directs the air supply onto the user's face, where the air-stream passes over the eyes before reaching the nose and mouth. As a result, the eyes tend to dry out and become uncomfortable. This problem can be exacerbated when the user wears spectacles that further channel the air stream into close contact with the eyes. The time the user can work before having to remove the hood can be reduced, causing increased work interruption with consequential lost time while the user moves to a safe environment.

Another problem with known respirator hoods is that they can provide areas where contaminants collect, which areas can be difficult or awkward to clean effectively. For example, the air supply line is often a corrugated hose that is permanently secured to the hood and cannot be easily cleaned in situ. This is a particular problem for hood use in a toxic environment where cleaning is performed at the end of each working day. The hood may become unusable and have to be thrown away although otherwise still in good condition.

SUMMARY OF THE INVENTION

The present invention seeks to provide an improved respirator, especially an improved respirator hood, that mitigates or overcomes one or more of the afore-mentioned problems of existing respirator hoods.

Thus at least some embodiments of the invention provide a respirator hood in which variations in the back pressure that the hood presents to the incoming air can be reduced or eliminated. More specifically, at least one embodiment of the invention aims to provide an air duct that retains its shape in use so that air can flow freely through the duct at all times.

One or more embodiments of the invention also provide a respirator hood in which the flow of air to the face region of the user is arranged so that drying of the eyes may be reduced. More especially, at least one embodiment of the invention aims to provide an air duct with an outlet that directs the air away from the eyes of the user.

Additionally, some embodiments of the invention provide a respirator hood or helmet in which at least part of the air duct can be removed for cleaning, servicing, or respirator repair or transfer to another respirator.

These and other benefits and advantages of the invention will be understood from the detailed description set forth below.

According to a first aspect of the present invention, there is provided a respirator hood to be worn on the head of a user to provide a supply of breathable air to a face region of the user, the hood having an air chamber arranged in an upper portion to extend over and above the head of a user, the air chamber having an inlet connectable to a source of breathable air and an outlet arranged to deliver breathable air to a face region of the user, wherein the air chamber defines a collapse-resistant air duct between the inlet and outlet.

As used herein, the term "collapse-resistant air duct" means the formed shape of the duct is stable and, if locally deformed, the duct can return to its original formed shape and does not retain the deformed shape when the deforming force is removed.

By arranging the air duct to be collapse-resistant, the shape of the air duct is maintained in use and the flow of air through the air duct is substantially unrestricted. As a result, a substantially uniform air flow can be achieved in use which is repeatable from day to day and between hoods.

In this way, variations in the back pressure that the hood presents to the air supply may be largely avoided. As a result, where a portable, battery powered turbo unit is employed to provide the air supply, the battery life can be controlled more reliably.

Further, by arranging the air chamber to extend over and above the head of the user, the air duct can have a large volume relative to the minimum flow requirements. As a result, the volume of the air chamber acts to smooth out any minor fluctuations in the air supply without having any substantial effect on the back pressure presented to the air supply. In a preferred arrangement, the air chamber covers substantially the whole of the region of the hood above the head of the user.

Preferably, the air chamber comprises an outer wall of the hood and an inner wall secured to the outer wall around a perimeter edge of the hood to define the air duct therebetween. In a preferred arrangement, the outer wall is the top wall of the hood and the outer wall and inner wall of the air chamber are made of transparent or translucent material. In this way, the air chamber acts to admit light to the interior of the hood and allows the user to see out through the top of the hood.

The outer wall and inner wall may be made of shape stable plastics materials such as polypropylene (PP), polyethylene terepthalate (PET), polyethylene terephthalate glycol (PET-G) or polycarbonate (PC). Alternatively, one of the outer wall and inner wall may be made of a shape stable plastics material and the other of the outer wall and inner wall may be made of a softer plastics material such as polyurethane (PU) or polyvinylchloride (PVC). In this arrangement, the wall of softer plastics material is maintained in a shape stable configuration by the other wall so as to render the air chamber collapse-resistant.

In this way, we may provide a hood having a top wall of soft plastics material with a collapse resistant air chamber by fitting a shape stable inner wall inside the hood to render the top wall shape stable. The inner wall may provide local support for the top wall. inboard of the perimeter of the hood to assist in maintaining the shape of the air chamber.

The outer wall and inner wall of the air chamber may be permanently secured together, for example by welding or adhesively bonding opposed marginal edges together. A side wall of the hood may be secured at the same time between the edges of the outer and inner walls. Alternatively, the edges of the outer and inner walls may be secured together and the side wall secured afterwards by welding or adhesive bonding to one side. The side wall may be made of a shape stable plastics material similar to the outer and/or inner walls of the hood. Alternatively, the side wall may be made of a softer plastics material that can change shape.

In another arrangement, the outer wall and inner wall of the air chamber may be releasably secured together and the side wall permanently secured to one of the outer and inner walls by welding or adhesive bonding. In a preferred embodiment, the side wall is permanently secured to the outer wall of the air chamber and the inner wall of the air chamber is releasably located and secured within the hood. As a result, if any air leaks between the outer and inner walls, it will be delivered to the user within the hood.

Advantageously, the inlet and outlet are provided in the inner wall of the air chamber. In this way, an air supply line, typically a hose, for connecting the air chamber to the supply of breathable air may be connected to the air chamber within the hood. Again, if any air leaks between the supply line and the inlet, it will be delivered to the user within the hood.

In a preferred arrangement, the outer wall and inner wall of the air chamber are secured together around the perimeter of the hood and are spaced apart inwardly of the perimeter. In this way, the air duct extends across the whole area of the hood above the head of the user and is not confined to the peripheral edge region of the hood. As a result, air can flow from the inlet to the outlet with less turbulence leading to reduced noise and create a more even flow of air from the outlet to the face region of the user.

Preferably, the outer wall and inner wall of the chamber are provided with smooth internal surfaces shaped to direct the flow of air from the inlet to the outlet without any sharp or sudden changes in direction. In this way, turbulence within the air chamber may be further reduced.

Advantageously, the inlet opens into the air chamber such that the air flow can spread out within the air chamber. As a result, a uniform flow of air from the inlet tot he outlet may be achieved such that the formation of separate air streams within the air chamber can be avoided.

In a preferred arrangement, the outer wall and inner wall of the chamber are dome-shaped to provide the upper portion of the hood with a recessed area over the head of the user. In this way, the head of the user may be received in the recessed area such that the overall height of the side wall of the hood may be reduced.

Preferably, the inlet and outlet are provided on opposite sides of the dome-shaped portion of the inner wall. In this way, the air flows around and over the dome-shaped portion of the inner wall thereby further assisting in obtaining a uniform air flow from the inlet to the outlet.

Advantageously, the inlet is provided at the rear of the dome-shaped portion of the inner wall and the inner wall is shaped to form a channel extending around the front of the dome-shaped portion with the outlet being arranged in the channel facing the side wall of the hood. As a result, the outlet directs the air flow from the air chamber towards the inner surface of the side wall away from the eyes of the user.

In a preferred arrangement, the outlet is arranged so that the air flow from the outlet contacts the inner surface of the side wall at or below the level of the eyes of the user in the hood. In this way, air flow is kept away from the eyes of the user so that drying out of the eyes by the air flow within the hood is reduced and user comfort may be increased allowing the user to wear the hood for longer periods of time. This may in turn result in potential cost savings by reducing lost working time caused by drying out of the eyes of the user.

The outlet may comprise an elongate slot formed in the channel but more preferably, the outlet comprises a plurality of holes formed in the channel. In a preferred arrangement, the outlet is provided by a symmetrical array of holes comprising a central hole and at least one pair of holes on opposite sides of the central hole. The holes may all be of the same size. More preferably, however, the hole size varies to compensate for the air flow within the chamber to achieve a substantially uniform flow of air to the face region of the hood. For example, the size of the holes may decrease progressively on each side of the central hole.

Advantageously, a transparent or translucent visor is provided at the front of the hood through which the user can see. The visor may be restricted to the face region of the user only. Alternatively, the visor may extend around the sides of the hood. The visor may form all or part of the side wall of the hood.

The visor may be an integral part of the hood. Alternatively, the visor may be detachable. In this way, a damaged visor can be easily replaced allowing continued use of the hood. Also, when the hood is eventually thrown away, an undamaged visor can be removed and re-used or kept as a spare for use in an emergency.

According to a second aspect of the present invention, there is provided a respirator hood to be worn on the head of a user to provide a supply of breathable air to a face region of the user, the hood having an air chamber in an upper portion above the head of the user, the air chamber having an upper wall and a lower wall defining an air duct therebetween, the lower wall having an inlet connectable to a source of breathable air and an outlet for delivery of breathable air to a face region of the user wherein at least one of the upper and lower walls has a stable profile to maintain the shape of the air duct.

Preferably, both the upper and lower walls have stable profiles such that the air duct has a pre-determined shape. In this way, variations in the shape of the air duct in use are avoided and the air flow through the duct can be controlled in a reliable manner that is repeatable from day to day and from hood to hood.

According to a third aspect of the present invention, there is provided a respirator hood to be worn on the head of a user to provide a supply of breathable air to a face region of the user, the hood having an air chamber in an upper portion above the head of the user, the air chamber having an inlet connectable to a source of breathable air and an outlet for delivery of breathable air to a face region of the user wherein the outlet is arranged to direct the air flow away from the face region of the user towards a side wall of the hood arranged to cover at least the face of the user.

Preferably, the outlet is formed in an inclined portion of the air chamber facing towards the side wall such that the air from the outlet flows down the inner surface of the side wall towards the nose and mouth regions of the user.

Advantageously, the inclined portion is arranged so that the air flow from the outlet contacts the inner surface of the side wall approximately at or below the level of the eyes of the user within the hood. In this way, the air flow is kept away from the eye region reducing the risk of the eyes drying out. This may be achieved by selecting the angle at which the inclined portion extends relative to the side wall in relation to the spacing of the outlet above the eyes. It is believed that an angle of 15 to 60 degrees relative to the side wall may be appropriate for most applications and that an angle of 45 degrees relative to the side wall may be suitable in many cases.

According to a fourth aspect of the present invention, there is provided a respirator hood or helmet to be worn on the head of a user to provide a supply of breathable air to a face region of the user, the respirator having an air chamber in an upper portion above the head of the user, the air chamber having an upper wall and a lower wall defining an air duct with an inlet connectable to a source of breathable air and an outlet for delivery of breathable air to a face region of the user wherein at least one of the upper wall and lower wall is releasable.

In one arrangement, one of the upper and lower walls is permanently connected to the respirator and the other wall releasable. In another arrangement, both the upper wall and lower wall are releasable either separately or as a unit. For example the upper and lower walls may be secured together.

According to a fifth aspect of the present invention there is provided a loose fitting respirator hood to be worn on the head of a user to provide a supply of breathable air to a face region of the user, the hood comprising a top wall arranged to extend over and above the head of the user and a side wall arranged to extend around the head of the user, an upper end of the side wall being permanently secured to the top wall and a lower end of the side wall being arranged to rest on the shoulders of the user to support the hood without the use of a harness, the hood further comprising an internal wall arranged to extend over and above the head of the user below the top wall to define with the top wall a shape stable air chamber, the internal wall having a marginal edge secured to the hood and, inboard of the marginal edge, an inlet connectable to a supply of breathable air and an outlet arranged to deliver breathable air to a face region of the user.

These and other advantages of the invention are more fully shown and described in the drawings and detailed description of this invention, where like reference numerals are used to represent similar parts. It is to be understood, however, that the drawings and description are for the purposes of illustration only and should not be read in a manner that would unduly limit the scope of this invention.

DETAILED DESCRIPTION OF THE PREFERRED EMBODIMENTS

In describing preferred embodiments of the invention, specific terminology is used for the sake of clarity. The invention, however, is not intended to be limited to the specific terms so selected, and it is to be understood that each term so selected includes all technical equivalents that operate similarly.

Figure 1:
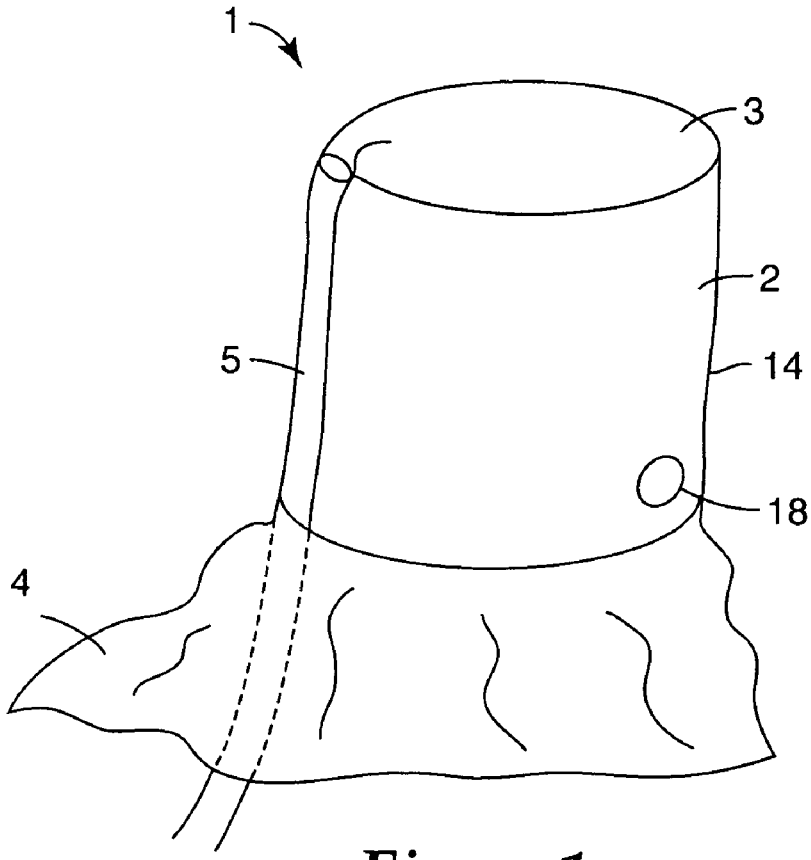
FIG. 1 is a schematic perspective view of a respirator hood according to a first embodiment of the invention.
Figure 3:
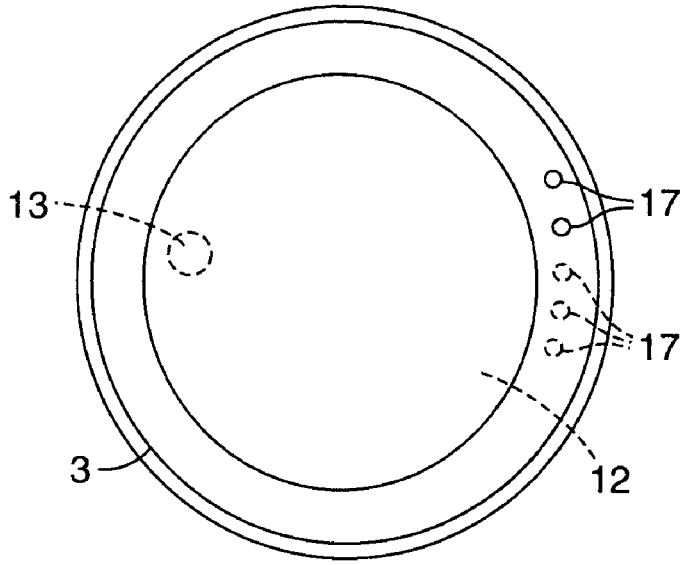
FIG. 3 is a schematic plan view of the hood shown in FIG. 1.
Figure 2:
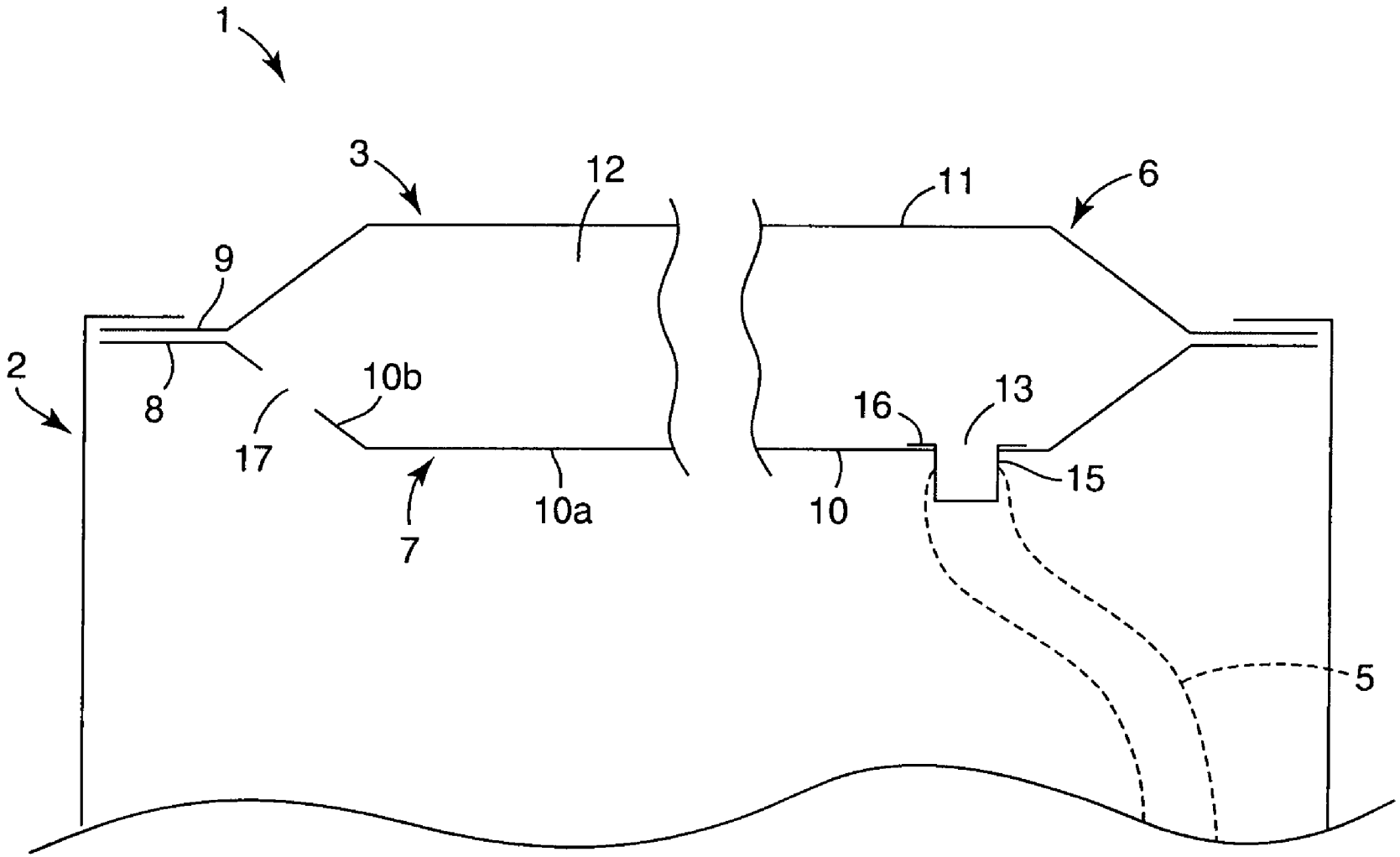
FIG. 2 is a schematic sectional view of the top half of the hood shown in FIG. 1.

FIGS. 1 to 3 show a respirator hood 1 that may be worn on the head of a user (not shown) to provide a supply of breathable air to a face region of the user. The hood 1 has a generally cylindrical side wall 2 closed at the upper end by a top wall 3. The lower end of the side wall 2 is intended to rest on the shoulders of the user and is provided with a flexible skirt 4 that rests on the upper body of the user and covers the interface with a body suit (not shown) when worn by the user.

The side wall 2 and top wall 3 may be made of a transparent plastic material such as polypropylene (PP), polyethylene terephthalate (PET), polyethylene terepthalate glycol (PET-G) or polycarbonate (PC) capable of imparting a stable shape to the hood 1 as described later herein. The skirt can be made of a softer plastic material such as polyurethane (PU), polyvinylchloride (PVC) or fabric coated with PU, PVC or the like and is capable of conforming to the upper body shape-of the user and may be colored.

The hood 1 connects to a supply of breathable air by a flexible hose 5. The hose 5 may be connected to a portable air supply (not shown) that is carried by the user or to a remote fixed air supply (not shown). Fixed air supplies such as a compressor are typically provided when working in a room or other enclosed space, and the user is provided with a regulator to adjust the air flow to the desired level. Portable air supplies are employed where the user requires a greater degree of freedom of movement and typically comprise a turbo unit incorporated in a back pack or a belt pack or other suitable means for carrying by the user.

Portable turbo units are well known and include a fan driven by a battery powered motor and a filter for removing particulate matter and/or toxic materials (gases, bacteria etc) from the air drawn into the unit by the fan. The turbo unit may be set during manufacture to provide a pre-determined air flow for a pre-determined period of time before the battery requires replacing or re-charging—for example, an air flow of 150–200 liters per minute for up to 4 hours.

The hose 5 connects the air supply (fixed or portable) to an air chamber 6 provided in an upper portion of the hood 1 above the head of the user. As shown in FIG. 2, the air chamber 6 may be formed between the top wall 3 and an internal wall 7. The internal wall 7 is made of the same transparent plastic material as the top wall 3 and has a peripheral edge flange 8 secured to an opposed peripheral edge flange 9 of the top wall 3 by welding or adhesive bonding. Any suitable form of welding may be employed including impulse welding (heat sealing), ultrasonic welding or radio frequency welding.

Inwardly of the edge flanges 8 and 9, the internal wall 7 and top wall 3 are provided with opposed recessed portions 10, 11 that extend away from each other to define an air duct 12 that extends across and over the head of the user.

The top wall 3 and internal wall 7 are pre-formed to the required shape by any suitable means, for example, vacuum forming, and the choice of material, shape and thickness of walls 3, 7 is such that the air chamber 6 is rendered collapse-resistant. In other words, the air chamber 6 retains its formed shape and returns to that shape if deformed when the deforming force is removed. In this way, the air chamber 6 is shape stable and the volume of the air duct 12 is fixed in a reliable manner that can be repeated from one hood to the next. The air chamber 6 also retains and maintains the side wall 2 to provide the cylindrical shape of the hood 1. The region of the side wall 2 at the front and sides of the hood 1 forms a visor 14 through which the user can see. In this embodiment, the user can also see through the top of the hood 1.

The air chamber 6 is provided with an air inlet in the internal wall 7 at the rear of the hood 1 and an air outlet in the internal wall 7 at the front of the hood 1. The air inlet comprises an annular opening 13 in the base 10*a* of the recessed portion 10 in which a hose coupling 15 is located. The coupling 15 has an external flange 16 that is secured to the internal wall 7 in fluid tight manner around the marginal edge of the opening by welding, adhesive bonding or any other suitable means. The hose 5 is releasably connected to the coupling 15 to allow the hose 5 to be detached for cleaning, replacement or re-use on another hood 1.

The air outlet comprises a plurality of holes 17 spaced apart in a circumferential direction in the side 10*b* of the recessed portion 10 facing the side wall 2 of the hood 1. The total cross-sectional area of the holes 17 is at least equal to and preferably greater than the cross-sectional area of the opening 13 so that air flow through the duct 12 is not restricted by the holes 17. In this way, the back pressure on the air supply to the hood 1 is not affected to any significant extent by the presence of the air chamber 6.

The side 10*b* of the recessed portion 10 in which the holes 17 are formed is inclined downwards and away from the side wall 2 of the hood 1 at an angle of approximately 45 degrees. As a result, the air flow from the holes 17 is directed downwardly away from the upper face region of the user towards the inner surface of the side wall 2 of the hood 1.

The air flow is arranged to contact the inner surface of the side wall 2 approximately at the level of the eyes of the user and flows down the inner surface to the nose and mouth region of the user for breathing in by the user and for flushing exhaled air from the hood 1 through one or more non-return check valves 18 provided at the lower end of the side wall 2. In this way, the air flow from the outlet holes 17 is kept away from the eyes of the user and drying of the eyes is reduced.

As will be appreciated, the air duct 12 extends over substantially the whole area of the top wall 3 of the hood 1 above the head of the user and has a large volume through which the air supply can flow with no sudden changes of direction. In particular, the recessed portions 10, 11 allow the incoming air supply to flow up into the air duct 12 and to spread out evenly within the air duct 12 without any sudden changes of direction.

As a result, the air flow through the air duct 12 is smoother with little or no turbulence. This reduces noise levels significantly and produces a more uniform flow of air from the air duct 12 through the holes 17. In this way, the air flow delivered to the interior of the hood 1 is distributed uniformly across the inner surface of the side wall 2. This reduces the occurrence of separate air streams that may give rise to excessive drying of the eyes of the user and provides a more regular air supply to the nose and mouth regions that improves breathing and efficient removal of exhaled air from the hood.

Further, because the air chamber 6 is collapse resistant, the air flow through the duct 12 can be maintained at a constant, predictable rate from day to day and from hood to hood. This has particular benefit where the hood 1 is used with a portable battery powered turbo unit carried by the user. Thus, restrictions to flow caused by partial or complete collapse of the air duct 12 giving rise to increased back pressures acting on the turbo unit are avoided and the life of the battery is not shortened by the fan having to work harder to overcome the back pressure. As a result, reliability of the turbo unit to provide a desired flow rate for a given period of time before the battery requires to be replaced is enhanced.

Figure 4:
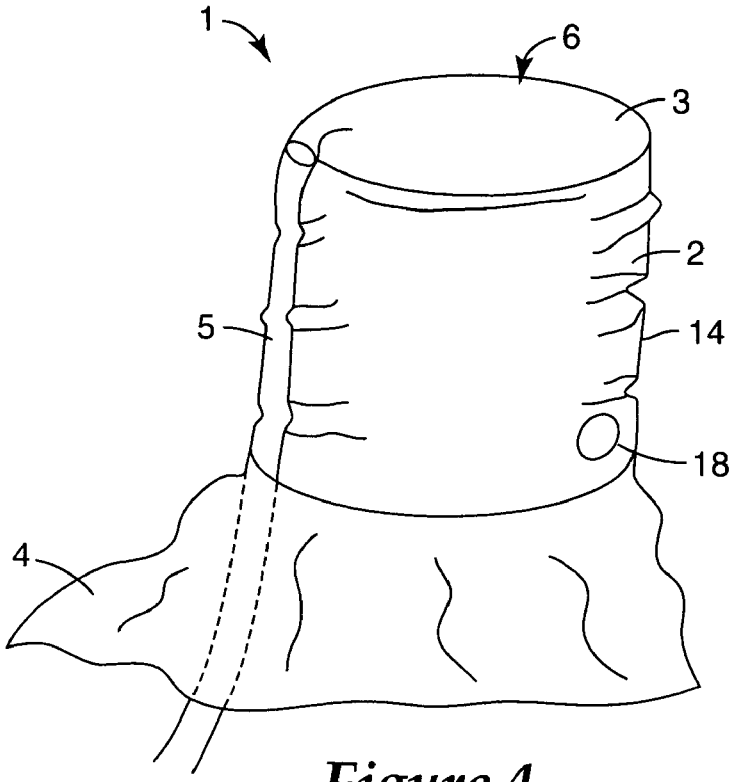
FIG. 4 is a schematic perspective view similar to FIG. 1 showing a modification to the hood.

Referring now to FIG. 4, a modification to the hood 1 is shown. For convenience, like reference numerals are used to indicate parts corresponding to FIGS. 1 to 3.

As shown in FIG. 4, the side wall 2 of the hood 1 is made of a softer transparent plastics material such as polyurethane (PU) or polyvinylchloride (PVC). As a result, the side wall 2 can flex and bend in a random manner so as to change shape from day to day and from one hood to another. Such flexing and bending of the side wall 2 does not, however, alter the shape of the air chamber 6 at the top of the hood 1. Accordingly, the shape and volume of the air duct 12 is maintained despite changes to the shape of the side wall 2 and the air chamber 6 provides a regular flow of breathable air to the user in a controlled manner as described previously.

Figure 5:
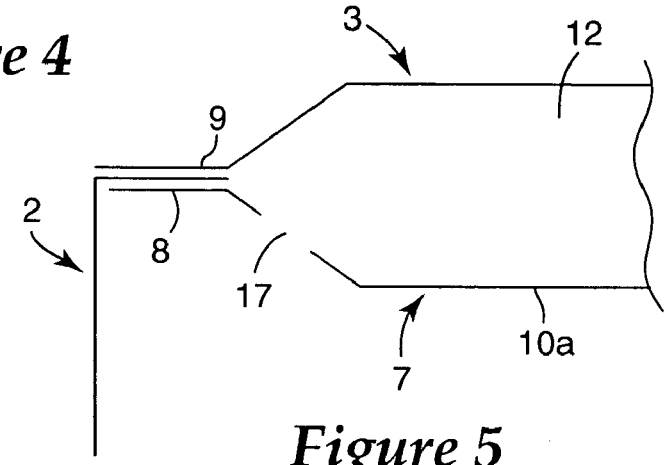
FIG. 5 is a schematic sectional view similar to FIG. 2 showing another modification to the hood.
Figure 6:
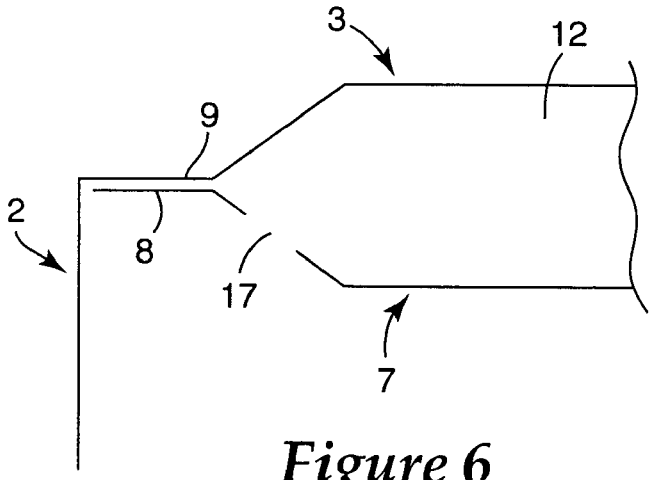
FIG. 6 is a schematic sectional view similar to FIG. 2 showing yet another modification to the hood.

FIGS. 5 and 6 illustrate two alternative methods of assembling the hood 1. For convenience, like reference numerals are used to indicate parts corresponding to FIGS. 1 to 3.

As shown in FIG. 5, the upper end of the side wall 2 is folded over and secured by welding or adhesive bonding between the edge flanges 8, 9 of the top wall 3 and internal wall 7. In this way, the top wall 3 and internal wall 7 are joined to the side wall 2 in a single operation and the areas where contaminants can collect may be reduced so that the hood 1 can be cleaned more easily and more reliably.

As shown in FIG. 6, the upper end of the side wall 2 is folded over and secured by welding or adhesive bonding to the edge flange 8 of the internal wall 7. The edge flange 9 of the top wall 3 has a reduced diameter and is secured by welding or adhesive bonding to the edge flange 8 substantially flush with the folded over upper end of the side wall 2. In this way, areas where contaminants may be trapped are largely avoided.

Figure 7:
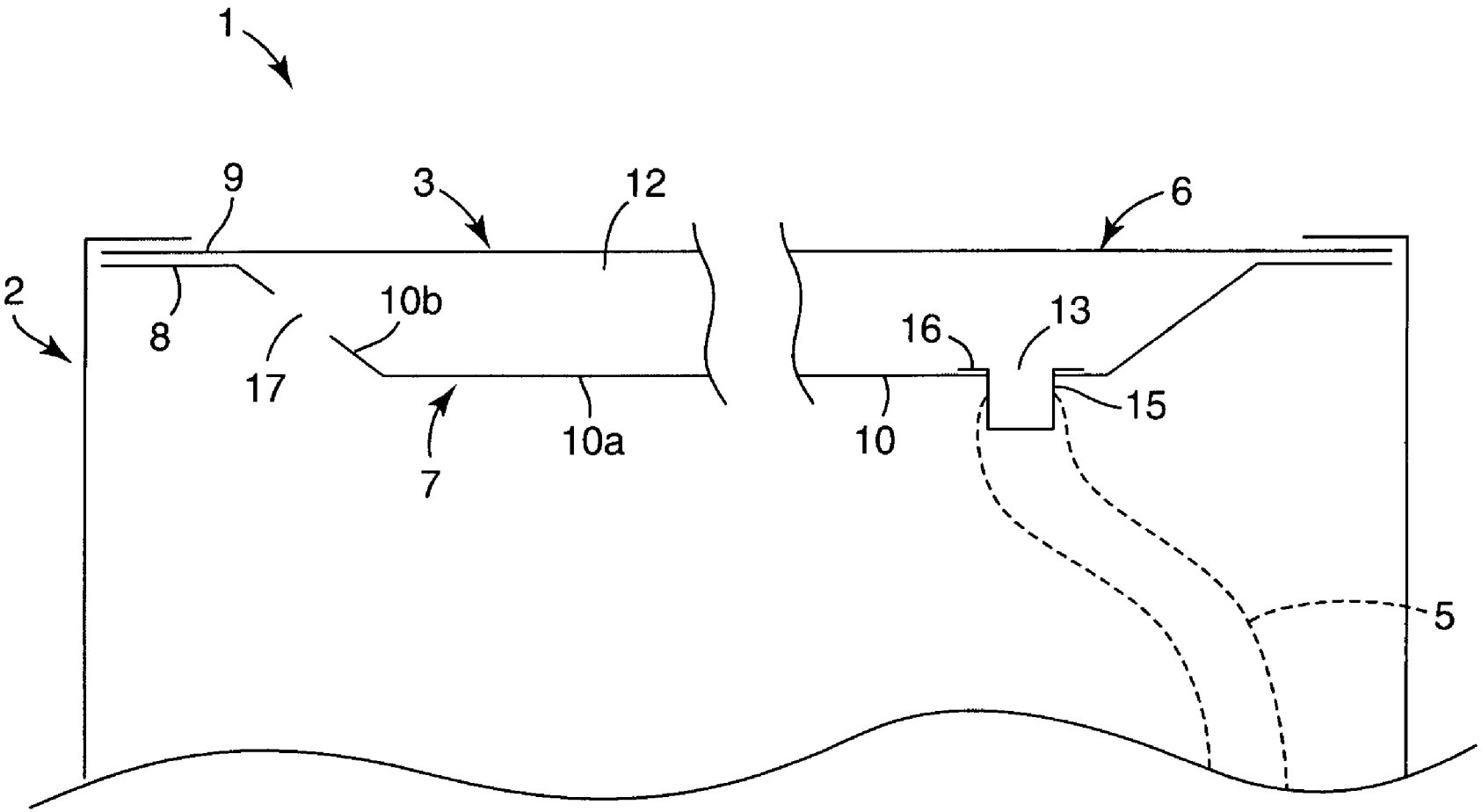
FIG. 7 is a schematic sectional view similar to FIG. 2 showing a still further modification to the hood.

In FIG. 7, a modified air chamber 6 for the hood 1 is shown. For convenience, like reference numerals are used to indicate parts corresponding to FIGS. 1 to 3.

As shown in FIG. 7, the top wall 3 of the air chamber 6 is flat and is secured around the marginal edge to the edge flange 8 of the internal wall 7 as described previously. The top wall 3 may be made of a shape stable plastics material similar to the internal wall 7 so as to render the air chamber 6 collapse resistant. Alternatively, the top wall 3 may be made of a softer, plastics material and the air chamber 6 rendered collapse resistant by securing the top wall 3 to the edge flange 8 of the internal wall 7 with the top wall 3 in a stretched, taut condition. The side wall 2 may be made of a shape stable plastics material similar to the internal wall 7 or a softer flexible material similar to the top wall 3. As will be appreciated, we may provide a collapse resistant air chamber in a hood 1 having a top wall 3 that is not shape stable by inserting and securing either permanently or releasably, a shape stable internal wall 7 inside the hood 1 to make the top wall 3 shape stable.

In a modification (not shown), the internal wall 7 may be provided with one or more raised portions that provide localized support for the top wall 3 to assist in maintaining the shape and volume of the air duct 12. In another modification (not shown), we may insert and secure either permanently or releasably a collapse-resistant air chamber 6 comprising an upper wall 3 and a lower wall 7 as described previously. In this way, we may convert or adapt an existing hood to provide a supply of breathable air in a reliable manner.

Figure 8:
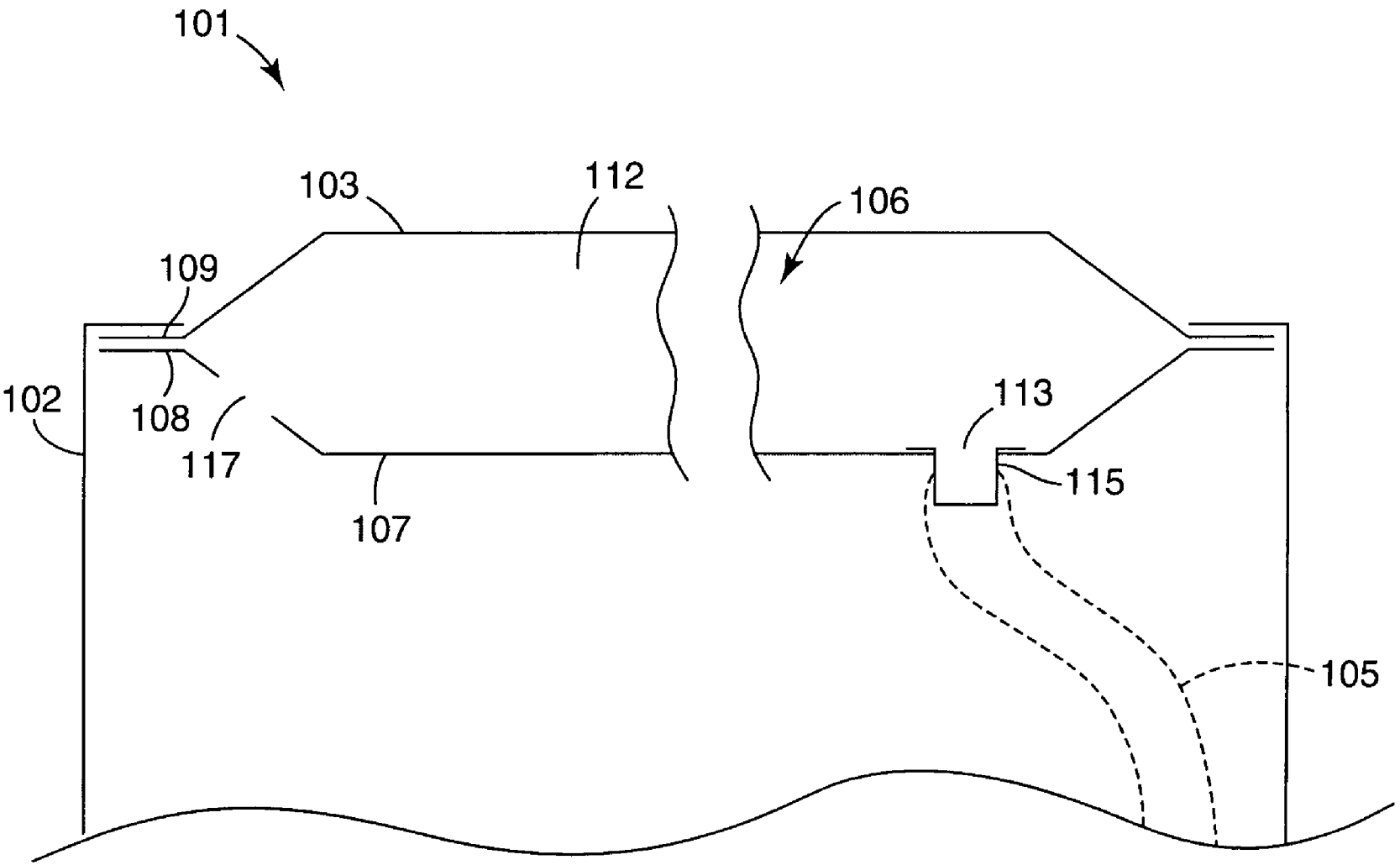
FIG. 8 is a schematic sectional view of the top half of a respirator hood according to a second embodiment of the invention.
Figure 9:
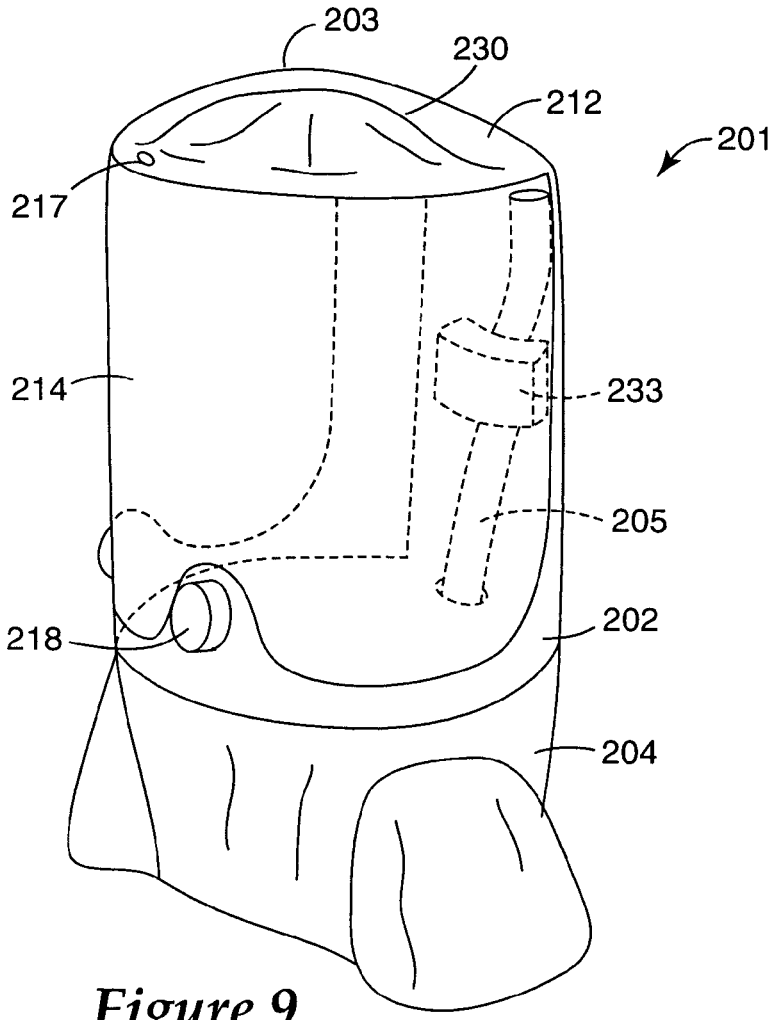
FIG. 9 is a schematic perspective view of the respirator hood according to a third embodiment of the invention.
Figure 10:
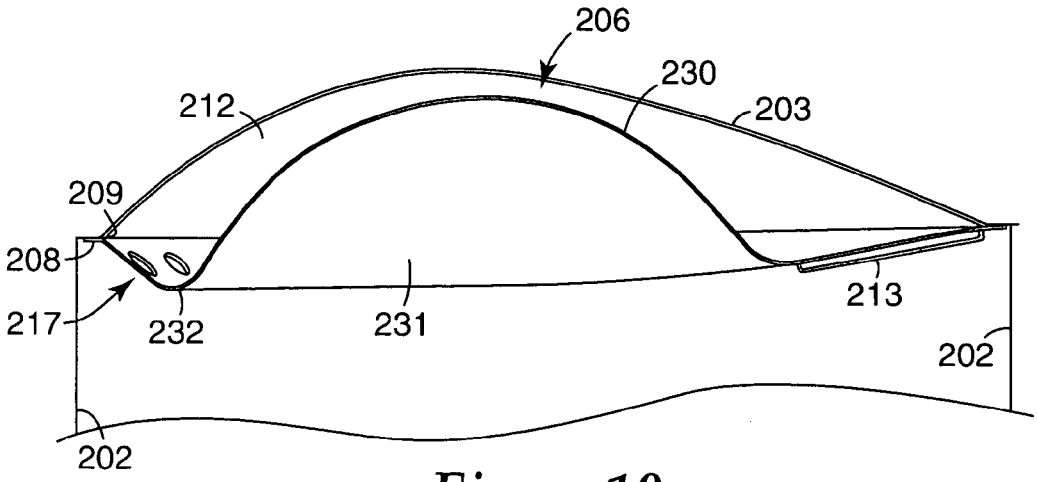
FIG. 10 is a schematic sectional view of the top half of the hood shown in FIG. 9.
Figure 11:
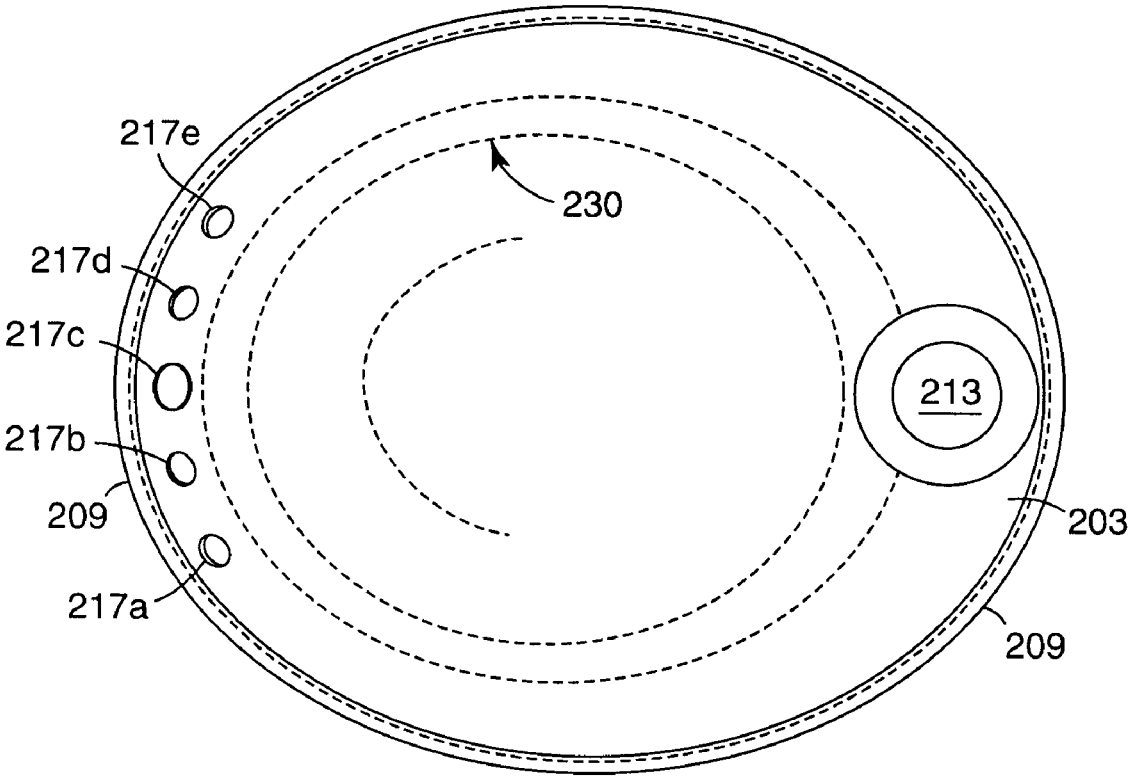
FIG. 11 is a schematic plan view of the hood shown in FIG. 9.
Figure 12:
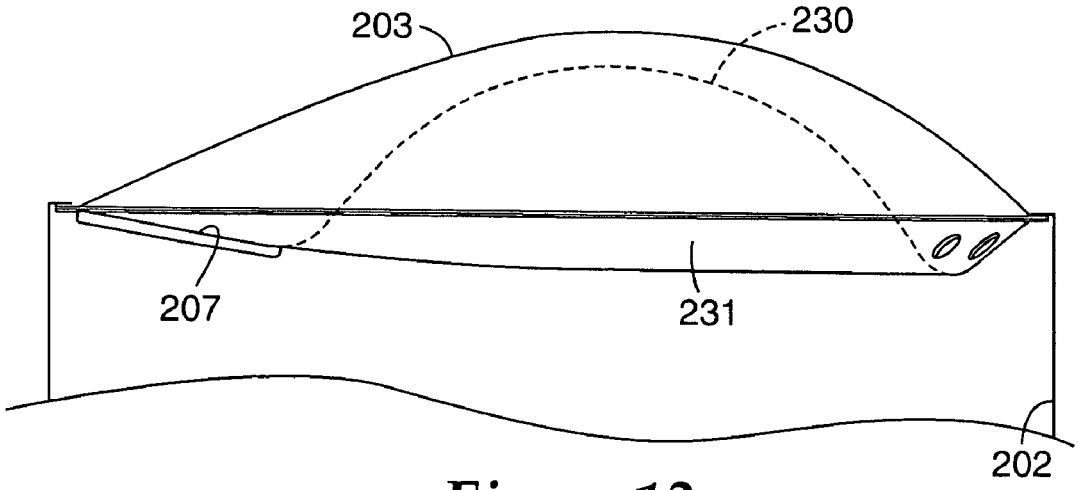
FIG. 12 is a schematic side view of top half of the hood shown in FIG. 9.

In FIG. 8, a respirator hood according to a second embodiment of the invention is shown in which like reference numerals in the series 100 are used to indicate parts corresponding to FIGS. 1 to 3.

In this embodiment, the upper end of the side wall 102 is turned over and secured in fluid tight manner by welding or adhesive bonding to the edge flange 109 of the top wall 103 as previously described. The internal wall 107 is inserted into the hood 101 and is releasably secured in a substantially fluid tight manner to the underside of the top wall 103 around the perimeter of the hood 101 to form the air chamber 106. Any suitable means (not shown) may be used to secure the internal wall 107 such as by poppers with additional sealing where required.

In this way, the internal wall 107 can be removed and replaced if damaged or removed and re-used with another hood 101 if the hood 101 is designed to be disposable. In this arrangement, the hose 105 may be permanently attached to the internal wall 107 so as to be detachable with the internal wall 107 as a unit for cleaning, replacement or re-use. In other respects, the operation of the hood 101 is similar to the first embodiment and will be understood from the description thereof.

In FIGS. 9 to 12 of the drawings, there is shown a third embodiment of a respirator hood according to the present invention in which like reference numerals in the series 200 are used to indicate parts corresponding to the previous embodiments.

In this embodiment, the shape of the top wall 203 and internal wall 207 is altered to reduce the overall height of the side wall 202 of the hood 201 and to allow styling of the shape of the hood 201 to enhance the appearance of the hood 201.

As shown 11, the hood 201 has an ovoid shape in plan view with the wider rounded end at the front of the hood 201 and the narrower rounded end at the rear of the hood 201.

The internal wall 207 has a dome-shaped central region 230 defining a recess 231 open to the underside in which the top of the head of the user can be received. The dome-shaped central region 230 is surrounded by a recessed channel 232 terminating in an outwardly directed edge flange 208.

The channel 232 is wider and shallower at the rear of the hood 201 in which the air inlet opening 213 is provided. The air outlet holes 217 are provided in the outer side of the channel 231 at the front of the hood 201.

In this embodiment there are five holes 217*a*, 217*b*, 217*c*, 217*d*, 217*e* arranged symmetrically about the central hole 217*c*. The outermost holes 217*a*, 217*e* are the same size and are smaller than the holes 217*b*, 217*d* which are also the same size and are smaller than the central hole 217*c*. The total area of the holes 217*a*, 217*b*, 217*c*, 217*d*, 217*e* is at least equal to and preferably greater than the area of the inlet opening 213.

The top wall 203 is also dome-shaped and extends over and is spaced from the dome-shaped central region 230 of the internal wall 207. The top wall 203 has an edge flange 209 that is secured by welding or adhesive bonding to the edge flange 208 of the internal wall 207. The side wall 202 of the hood 201 is also secured to the edge flanges 207, 208 by any of the methods described previously.

The air chamber 206 formed by the dome-shape of the internal wall 207 and top wall 203 defines an air duct 212 that extends over and around the dome-shaped central region 230 of the internal wall 207. Both the internal wall 207 and top wall 203 are provided with smoothly curved internal surfaces and the inlet opening 213 is spaced below the curved surface of the top wall 203. As a result, the incoming air supply can flow into the air duct 212 and spread out evenly within the air duct 212 producing a more uniform flow of air through the duct 212 without any sudden changes of direction. In this way, the air flow through the air duct 212 is smoother with little or no turbulence.

The variation in size of the outlet holes 217*a*, 217*b*, 217*c*, 217*d*, 217*e* compensates for the different length of the flow paths from the inlet opening 213 over and around the dome-shaped central region 230 of the internal wall 207 so that outflow of air from each of the holes 217*a*, 217*b*, 217*c*, 217*d*, 217*e* is substantially the same.

As shown the outer side of the channel 232 in which the holes 217*a*, 217*b*, 217*c*, 217*d*, 217*e* are formed is inclined downwards and away from the side wall 202 of the hood 201 at an angle of approximately 45 degrees so that the air flow is directed towards and contacts the inner surface of the side wall 202 approximately at the level of the eyes of the user. In this way, the air flow is kept away from the eyes of the user so that drying of the eyes is reduced increasing comfort for the user. In other respects the operation of this embodiment is similar to the first embodiment and will be understood from the description thereof.

As will be appreciated, the dome-shapes of the top wall 203 and internal wall 207 allow the overall height of the side wall 202 of the hood 201 to be reduced by providing a recess 231 for the top of the head of the user. As a result, stability of the hood 201 may be enhanced further increasing comfort for the user.

Additionally, the height of the holes 271*a*, 217*b*, 217*c*, 217*d*, 217*e* above the level of the eyes of the user is reduced compared to the arrangement of FIGS. 1 to 3. As a result, there is less space available above the level of the eyes for the air flow through the holes 217*a*, 217*b*, 217*c*, 217*d*, 217*e* to spread out and cause drying of the eyes thereby further increasing comfort for the user.

The hood 201 is intended to fit over the head of the user and rest on the shoulders with the internal wall 207 spaced above the head of the user. For some users, however, the top of the head may contact the dome-shaped recess 231 of the internal wall 207. Accordingly, we may provide a ring of foam rubber or the like (not shown) around the inside of the dome-shaped recess 231 of the internal wall 207 to increase comfort for the user if the internal wall 207 contacts the head of the user.

We may also increase comfort for the user by providing one or more pads 233 of foam rubber or the like over the portion of the air hose 205 that extends within the hood 201 to prevent the back of the head of the user contacting and rubbing against the hose 205. Where provided, such pads 233 are preferably detachable so as to be removable for cleaning, replacement or re-use.

It will be appreciated that the exemplary embodiments described herein are intended to illustrate the diverse range and application of the invention and that features of the embodiments may be employed separately or in combination with any other features of the same or different embodiments.

Moreover, while the exemplary embodiments described and illustrated are believed to represent the best means currently known to the applicant, it will be understood that the invention is not limited thereto and that various modifications and improvements can be made within the spirit and scope of the invention as generally described herein.

For example, in some of the above-described embodiments, the side wall of the hood is made collapse-resistant similar to the air duct. As a result, if the user takes a deep breath inhaling a larger volume of air than is delivered to the hood, air may be drawn into the hood under the skirt. We may therefore provide a gusset of softer material (not shown) in the side wall of the hood that is capable of deflecting to adapt the hood to accommodate variations in the internal volume caused by breathing of the user.

Where provided such gusset may be made of polyurethane (PU) polyvinylchloride (PVC) or other suitable material arranged at the back of the hood so as not to interfere with visibility. Additionally, the gusset may be colored. The provision of a colored gusset behind the head of the user may be beneficial in helping to reduce glare/reflection within the hood and improve visibility. Where the side wall of the hood is made of softer, flexible material that changes shape more readily, the side wall can deflect to accommodate any change in the internal volume and a gusset may not be required.

The air outlet from the air chamber may comprise an array of holes as described. Alternatively, one or more elongate slots may be provided extending in a circumferential direction which may provide a more even distribution of the air flow within the head space of the hood.

The air chamber may extend across substantially the whole area of the top of the hood as described. It will be understood, however, that this is not essential and that the air chamber may be of any suitable shape that provides a collapse-resistant air duct above the head of the user. In addition, we may extend the air chamber into the side wall region of the hood so that the collapse resistant duct extends towards the lower end of the side wall at the back of the hood. As a result, the air supply hose may be connected to the air chamber at or near the bottom of the hood. In this way, the air supply hose may not extend into the hood to any appreciable extent thereby increasing comfort for the user and facilitating cleaning the inside of the hood.

The hood may be secured over the head of the user by means of a draw string (not shown) and releasably attaching the skirt to a waist belt with length adjustable straps secured by interengageable male and female connectors. In this way, the position of the hood may be adjusted for comfort by altering the length of the straps.

The visor may be an integral part of the side wall of the hood as described and we may provide disposable transparent cover sheets that can be releasably secured over the visor to provide protection against scratching or other damage to the face piece that could render the hood unusable. Alternatively, the visor may be a separate part detachably mounted in the side wall of the hood such that it can be removed and replaced if damaged.

It will also be appreciated that the appearance of the hood can be altered externally as desired by changing the shape of the air chamber. In this way, the styling of the hood can be enhanced to improve user acceptance.

While the invention has been described with particular reference to respirator hoods, it will be understood that one or more features described herein may have wider application to both respirator hoods and respirator helmets that provide head protection. For example, the provision of an air outlet to direct the air flow away from the eyes of the user or an air duct that can be opened for cleaning internal surfaces may have application to respirator helmets and the scope of the invention is to be construed accordingly. Other modifications and improvements that can be made will be apparent to those skilled in the art.

This invention may take on various modifications and alterations without departing from the spirit and scope thereof. Accordingly, it is to be understood that this invention is not to be limited to the above-described, but it is to be controlled by the limitations set forth in the following claims and any equivalents thereof.

It is also to be understood that this invention may be suitably practiced in the absence of any element not specifically disclosed herein.

All patents and patent applications cited above, including those in the Background section, are incorporated by reference into this document in total.

What is claimed is:

1. A respirator hood to be worn on the head of a user to provide a supply of breathable air to a face region of the user, the hood having an air chamber arranged in an upper portion to extend over and above the head of a user, the air chamber having an inlet connectable to a source of breathable air and an outlet arranged to deliver breathable air to a face region of the user, wherein the air chamber defines a collapse-resistant air duct between the inlet and outlet wherein the air chamber comprises an outer wall of the hood and an inner wall secured to the outer wall around a perimeter edge of the hood to define the air duct therebetween, and wherein the inner wall is shaped to form a channel extending around a front of a dome-shaped portion with the outlet being arranged in a side of the channel facing a side wall of the hood.

2. The respirator hood of claim 1, wherein the air chamber provides support at a perimeter of the hood for a visor that covers at least the face of the user.

3. The respirator hood of claim 2, wherein the visor is restricted to the face region of the user only.

4. The respirator hood of claim 2, wherein the visor extends around the head of the user to enclose fully of the head.

5. The respirator hood of claim 2, wherein the visor comprises a transparent or translucent portion of the hood through which the user can see.

6. The respirator hood of claim 2, wherein the visor forms at least part of a side wall of the hood.

7. The respirator hood of claim 6, wherein the visor is formed integrally with the side wall.

8. The respirator hood of claim 1, wherein the outer wall and inner wall of the air chamber are made of transparent or translucent material.

9. The respirator hood of claim 1, wherein at least one of the outer wall and the inner wall is shape stable.

10. The respirator hood of claim 9, wherein the inner wall is shape stable.

11. The respirator hood of claim 10, wherein the inlet and outlet are provided in the inner wall of the air chamber.

12. The respirator hood according to claim 11, wherein an air supply line is connectable to the inlet within the hood.

13. The respirator hood of claim 12, wherein the inlet is releasably connectable to the air supply line.

14. The respirator hood of claim 12, wherein the inlet is permanently connected to the air supply line.

15. The respirator hood of claim 9, wherein the top wall and inner wall of the air chamber are secured together around the perimeter of the hood and are spaced apart inwardly of the perimeter.

16. The respirator hood of claim 1, as wherein the side wall is shape stable.

17. The respirator hood of claim 1, as wherein the side wall is non-shape stable.

18. The respirator hood of claim 1, wherein the shape stable wall is made of a plastics material selected from the group comprising polypropylene (PP), polyethylene terephthalate (PET), polyethylene terephthalate glycol (PET-G) and polycarbonate (PC).

19. The respirator hood of 1, wherein the non shape stable walls are made of polyurethane (PU) or polyvinylchioride (PVC).

20. The respirator hood of claim 1, wherein the outer wall is a top wall of the hood.

21. The respirator hood of claim 20, wherein the top wall and inner wall of the air chamber are permanently secured together.

22. The respirator hood of claim 21, wherein the side wall is permanently secured to the top wall and inner wall.

23. The respirator hood of claim 20, wherein the top wall and inner wall of the air chamber are releasably secured together.

24. The respirator hood of claim 23, as wherein the side wall is permanently secured to one of the top wall and inner wall.

25. The respirator hood of claim 24, wherein the side wall is permanently secured to the top wall of the air chamber and the inner wall of the air chamber is releasably located and secured within the hood.

26. The respirator hood of claim 1, wherein the air duct extends across the whole area of the hood above the head of the user and is not confined to the peripheral edge region of the hood.

27. The respirator hood of claim 1, wherein the top wall and inner wall of the chamber are provided with smooth internal surfaces shaped to direct the flow of air from the inlet to the outlet without any sharp or sudden changes in direction.

28. The respirator hood of claim 27, wherein the inlet opens into the air chamber to assist the air flow to spread out within the air chamber.

29. The respirator hood of claim 28, wherein the top wall and inner wall of the chamber are dome-shaped to provide the upper portion of the hood with a recessed area open to the underside over the head of the user.

30. The respirator hood of claim 29, wherein the inlet and outlet are provided on opposite sides of the dome-shaped portion of the inner wall.

31. The respirator hood of claim 29, wherein the inlet is provided at the rear and the outlet is provided at the front of the dome-shaped portion of the inner wall.

32. The respirator hood of claim 29, wherein the inner wall is shaped to form a channel extending around the front of the dome-shaped portion with the outlet being arranged in the side of the channel facing the side wall of the hood.

33. The respirator hood of claim 1, wherein the outlet comprises at least one elongate slot.

34. The respirator hood of claim 1, wherein the outlet comprises a plurality of holes.

35. The respirator hood of claim 34, wherein the holes are arranged in a symmetrical array comprising a central hole and at least one pair of holes on opposite sides of the central hole.

36. The respirator hood of claim 35, wherein the holes are all of the same size.

37. The respirator hood of claim 35, wherein the size of the holes decreases progressively on each side of the central hole.

38. The respirator hood of claim 1, wherein the outlet is formed in a portion of the air chamber that is inclined to direct the air flow away from the face region of the user.

39. The respirator hood of claim 38, wherein the inclined portion extends at an angle of 15 to 60 degrees relative to a side wall of the hood.

40. The respirator hood of claim 39, wherein the inclined portion extends at approximately 45 degrees.

41. A respirator hood to be worn on the head of a user to provide a supply of breathable air to a face region of the user, the hood having an air chamber arranged in an upper portion to extend over and above the head of a user, the air chamber having an inlet connectable to a source of breathable air and an outlet arranged to deliver breathable air to a face region of the user, wherein the air chamber defines a collapse-resistant air duct between the inlet and outlet, wherein the air chamber comprises an outer wall of the hood and an inner wall secured to the outer wall around a perimeter edge of the hood to define the air duct therebetween, and wherein at least one of the outer wall and the inner wall are non-shape stable.

42. A respirator hood to be worn on the head of a user to provide a supply of breathable air to a face region of the user, the hood having an air chamber arranged in an upper portion to extend over and above the head of a user, the air chamber having an inlet connectable to a source of breathable air and an outlet arranged to deliver breathable air to a face region of the user, wherein the air chamber defines a collapse-resistant air duct between the inlet and outlet wherein the air chamber comprises an outer wall of the hood and an inner wall secured to the outer wall around a perimeter edge of the hood to define the air duct therebetween, and wherein the outlet is formed in a portion of the air chamber that is inclined to direct a flow of air from the air chamber away from the face region of the user.

43. The respirator hood of claim 42, wherein the outlet is inclined at an angle of 15 to 60 degrees relative to a side wall of the hood.

44. The respirator hood of claim 43, wherein the outlet is inclined at approximately 45 degrees.

45. A respirator hood to be worn on the head of a user to provide a supply of breathable air to a face region of the user having eyes, the hood a side wall and having an air chamber arranged in an upper portion to extend over and above the head of a user, the air chamber having an inlet connectable to a source of breathable air and an outlet arranged to deliver breathable air to a face region of the user, wherein the air chamber defines a collapse-resistant air duct between the inlet and outlet, wherein the air chamber comprises an outer wall of the hood and an inner wall secured to the outer wall around a perimeter edge of the hood to define the air duct therebetween, and wherein a flow of air from the outlet contacts the side wall at or below a level of the eyes of the user.

* * * * *

UNITED STATES PATENT AND TRADEMARK OFFICE

CERTIFICATE OF CORRECTION

PATENT NO. : 7,104,264 B2
APPLICATION NO. : 10/809106
DATED : September 12, 2006
INVENTOR(S) : Peter D. Lee It is certified that error appears in the above-identified patent and that said Letters Patent is hereby corrected as shown below:

On Title Page Item (57)
Abstract
Line 4, after "air outlet" delete "17" and insert -- 17.--, therefor.

Column 3
Line 63, delete "wall. inboard" and insert -- wall inboard --, therefor.

Column 7
Line 30, delete "shape-of" and insert -- shape of --, therefor.

Column 14
Line 15, in Claim 19, delete "polyvinylchioride" and insert -- polyvinylchloride --, therefor.

Signed and Sealed this

Fifth Day of December, 2006

JON W. DUDAS
*Director of the United States Patent and Trademark Office*